United States Patent [19]

Igeta et al.

[11] 4,065,256

[45] Dec. 27, 1977

[54] METHOD FOR GRAFT POLYMERIZATION OF SHAPED ARTICLE OF HYDROPHOBIC SYNTHETIC POLYMER

[75] Inventors: Kikuji Igeta; Masakatsu Ohguchi, both of Shiga, Japan

[73] Assignee: Toyo Boseki Kabushiki Kaisha, Osaka, Japan

[21] Appl. No.: 654,714

[22] Filed: Feb. 2, 1976

[30] Foreign Application Priority Data

Jan. 31, 1975 Japan ..... 50-13506

[51] Int. Cl.[2] ..... D06M 13/00; D06M 13/20

[52] U.S. Cl. ..... 8/115.5; 8/115.7; 8/119; 8/120; 8/DIG. 18; 260/823; 260/857 G; 260/873; 260/875; 260/878 R; 260/898

[58] Field of Search ..... 8/115.5, DIG. 18, 120, 8/115.7, 119; 260/857 G, 873, 878 R, 823, 875, 898

[56] References Cited

U.S. PATENT DOCUMENTS

| | | | |
|---|---|---|---|
| 3,649,494 | 3/1972 | Sakurada et al. | 204/159.15 |
| 3,660,554 | 5/1972 | Okamura et al. | 264/78 |
| 3,847,657 | 12/1974 | Rieber et al. | 117/135.5 |
| 3,909,195 | 9/1975 | Machell et al. | 8/115.7 |

*Primary Examiner*—John Kight, III

*Attorney, Agent, or Firm*—Wenderoth, Lind & Ponack

[57] ABSTRACT

A shaped article of hydrophobic synthetic polymer is graft polymerized uniformly and economically in a high yield, and consequently is endowed with various advantageous properties, when it is treated in an aqueous emulsified dispersion having dispersed in water an hydrophobic radical polymerization initiator, an organic solvent which is liquid at normal room temperature, naphthalene and an unsaturated monomer containing in the molecular unit thereof at least one double bond capable of radical polymerization.

23 Claims, No Drawings

METHOD FOR GRAFT POLYMERIZATION OF SHAPED ARTICLE OF HYDROPHOBIC SYNTHETIC POLYMER

BACKGROUND OF THE INVENTION

The methods heretofore suggested for graft polymerization on hydrophobic synthetic fibers include a method utilizing a high-energy radiation, which is discussed at page 615, Part C No. 4 of the Journal of Polymer Science (1963) and in U.S. Pat. No. 3,274,295, a method utilizing low-temperature plasma which is disclosed in the U.S. Pat. No. 3,600,122, a method utilizing a persulfate which is disclosed in U.S. Pat. No. 3,297,471 and a method resorting to oxidation with ozone which is touched upon at page 753, Part C No. 4 of the Polymer Science (1963). The method which utilizes a high-energy radiation has a disadvantage that the radiation degrades the properties of the fibers under treatment. In addition, it entails an economical problem in that the cost of equipment is high. The method which utilizes low-temperature plasma necessitates a system operable under a reduced pressure and, therefore, fails to provide easy voluminous treatment from the operational point of view and proves to be economically handicapped. Besides, since the modification aimed at is limited to the very surface layer, it is difficult to obtain the effect of modification to a thorough extent. The method which utilizes a persulfate and the method which resorts to the oxidation with ozone generally provide graft polymerization of inferior efficiency and give deficient modification. Particularly in the case of fibers of high crystallinity, the efficiency of graft polymerization is extremely low so that, depending on the particular unsaturated monomer in use, the conversion of graft polymerization which is obtained at all is of a virtually negligible degree.

On the other hand, methods which accomplish the desired graft polymerization by use of a hydrophobic radical polymerization initiator have been disclosed by Japanese Patent Publication No. 502/1970 and Japanese Patent Publication No. 27743/1973. The former invention relates to a two-stage process whereby a hydrophobic synthetic polymer is subjected first to a treatment for activation with a hydrophobic radical polymerization initiator and then is reacted upon by an unsaturated monomer, whereas the latter invention concerns a single-stage process whereby a shaped article of aromatic polyester is treated in an aqueous dispersion consisting of a specific hydrophobic organic solvent, a hydrophobic radical polymerization initiator, a hydrophilic unsaturated monomer and an emulsifier. The method of the former invention is economically disadvantageous in the sense that the two-stage process calls for a highly complicated operation and consumes a considerably large amount of time. What is more, it is difficult to obtain uniform graft polymerization stably because uniformization of graft polymerization is impeded such as by the phenomenon of inactivation which occurs while the fiber under treatment is in the process of shifting from the treatment for activation to the stage of graft polymerization. The method of the latter invention, notwithstanding the advantage of one-stage process, suffers from serious defects such as lack of uniformity of graft polymerization and unsatisfactory efficiency of graft polymerization, which pose a great hindrance to the commercialization of the method.

SUMMARY OF THE INVENTION

This invention relates to a method for the graft polymerization of a shaped article of hydrophobic synthetic polymer and more particularly to a method for graft polymerizing onto said shaped article of hydrophobic synthetic polymer an unsaturated monomer containing in the molecular unit thereof at least one double bond capable of radical polymerization.

An object of the present invention is to provide a graft polymer at low cost by causing an unsaturated monomer to be graft polymerized efficiently onto a shaped article of hydrophobic synthetic polymer.

Another object of the present invention is to provide a method for graft polymerizing a shaped article of hydrophobic synthetic polymer uniformly, and not merely in the surface region of said shaped article but also into the inner region as occasion demands, without entailing any degradation in the properties of said article.

Still another object of the present invention is to impart economically to the graft polymerization product advantageous properties variable with the particular kind of unsaturated monomer in use such as, for example, hydrophilicity, antistatic property, dirtproofing property and dyeability with ionic dyestuffs in the case of unsaturated monomers possessed of —COOH group, $—CONH_2$ group, $—SO_3H$ group, $—PO_3H_2$ group, polyoxyalkylene group, etc., flame-retardancy in the case of unsaturated monomers possessed of halogen atoms or phosphorus atom, pliability and water-repellency in the case of unsaturated monomers possessed of higher alkyl groups, oil-repellency and dirtproofing property in the case of unsaturated monomers possessed of perfluoroalkyl groups, infusibility in the case of unsaturated monomers possessed of two or more radically polymerizable double bonds in the molecular unit and light-fastness in the case of unsaturated monomers possessed of a hindered phenol group, and so on.

The inventors have undertaken to overcome the various shortcomings suffered by the conventional methods and have consequently discovered a novel method. The present invention is accomplished on the basis of this discovery. To be specific, this invention relates to a method for effecting graft polymerization uniformly and economically at a high conversion on a shaped article of hydrophobic synthetic polymer by treating said shaped article of hydrophobic synthetic polymer with an aqueous dispersion having dispersed in water, in the form of an emulsion, a hydrophobic radical polymerization initiator, an organic solvent which is liquid at normal room temperature, naphthalene and an unsaturated monomer containing in the molecular unit thereof at least one double bond capable of radical polymerization.

The method of the present invention enjoys advantages that the graft polymerization is accomplished in a single stage by an easy operation, that the graft polymerization is always obtained in a stable, reproducible conversion, that the time consumed by the graft polymerization is short, that dyeing and processing devices ordinarily installed at dye factories can be utilized in their unaltered form without requiring any special apparatus, and so on. Besides, owing to the use of naphthalene, high conversion of graft polymerization can be obtained even when the graft polymerization is carried out in a system of a high bath ratio using a diluted solution of unsaturated monomer. As a consequence, the uniformity of graft polymerization can be improved all the more.

The reason for this effect of the addition of naphthalene in the method of the present invention remains yet to be elucidated. It is, however, a really surprising phenomenon peculiar to naphthalene. If in the graft polymerization of a polyester, for example, naphthalene is also used in an aqueous dispersion containing a hydrophobic radical polymerization initiator, a hydrophobic organic solvent which is liquid at normal room temperature and an unsaturated monomer containing in the molecular unit thereof at least one double bond capable of radical polymerization, then the efficiency of graft polymerization is about two times as high as when no naphthalene is added to the aqueous dispersion. However, when a naphthalene derivative such as $\alpha$-methyl naphthalene, dimethyl naphthalene or $\beta$-naphthol is used in place of naphthalene in the aqueous dispersion, the efficiency of graft polymerization is lessened rather than enhanced. Particularly in the case of $\alpha$-methyl naphthalene, there is entailed a serious disadvantage that the graft polymer is discolored in a yellow tint. Also when a polyester-swelling agent such as diphenyl, o-phenylphenol, naphthyl benzoate or phenyl benzoate is added in place of naphthalene to said aqueous dispersion, the efficiency of graft polymerization is observed to decline. The specific function of naphthalene is self-evident in the light of these observations.

DETAILED DESCRIPTION OF THE INVENTION

Examples of the hydrophobic synthetic polymers which are usable in the present invention include polyesters, polyamides, polyolefins, polyacrylonitriles and various modified polymers thereof such as polymers modified so as to acquire dyeability with ionic dyestuffs and polymers modified so as to acquire antistatic property. Among these, aromatic polyesters and various modified polymers thereof are particularly effective. These hydrophobic synthetic polymers may be shaped in various forms such as, for example, tows, downy masses, threads, knit fabrics, woven fabrics, nonwoven fabrics, floorings, films and synthetic paper.

Examples of the hydrophobic radical polymerization initiators which are usable in the present invention include diacyl peroxides such as benzoyl peroxide and para-chlorobenzoyl peroxide, peroxy esters such as t-peroxy isobutylate, t-peroxy laurate and t-peroxy acetate, ketone peroxides such as cyclohexanone peroxide and methyl ethyl ketone peroxide, dialkyl peroxides such as dicumyl peroxide, t-butyl cumyl peroxide and di-t-butyl peroxide, hydroperoxides such as t-butyl hydroperoxide, para-methane hydroperoxide and cumene hydroperoxide, and azobis-isobutyronitrile and perbenzoic acid. Where the graft polymerization is effected by the immersion method with due consideration of the decomposition temperature, diacyl peroxides and dialkyl peroxides prove to be advantageous. Use of benzoyl peroxide or dicumyl peroxide proves specifically preferable. In the method whereby the given article is impregnated with the treating liquid and thereafter heated at an elevated temperature and in the method whereby the graft polymerization is effected in the form of image transfer using an inactive carrier, ketone peroxides and hydroperoxides which have high decomposition temperatures may be cited as desirable radical polymerization initiators.

The amount of said hydrophobic radical polymerization initiator to be used is generally from 0.005 to 5% by weight, preferably from 0.05 to 0.5% by weight, based on the aqueous dispersion being used for graft polymerization, although it is variable with the kind of initiator used, the conditions of graft polymerization, the desired conversion of graft polymerization, etc.

Examples of the organic solvents which are liquid at normal room temperature and which are usable in the present invention include alcohols such as methyl alcohol, ethyl alcohol, cyclohexanol, benzyl alcohol and phenyl methyl carbinol, phenols such as phenol and cresol, ketones such as acetone, methyl ethyl ketone, diethyl ketone and cyclohexanone, ethers such as dioxane, ethyleneglycol monomethyl ether, ethyleneglycol monoethyl ether and ethyleneglycol monophenyl ether, linear hydrocarbons such as octane, nonane and decane, alicyclic hydrocarbons such as cyclohexane and Decalin, aromatic hydrocarbons such as benzene, toluene, xylene and Tetralin, halogenated aliphatic hydrocarbons such as trichloroethane, trichloroethylene, tetrachloroethane and tetrachloroethylene and halogenated aromatic hydrocarbons such as monochlorobenzene, dichlorobenzene, trichlorobenzene and monochlorotoluene. Desirable are hydrophobic organic solvents. From the standpoint of the efficiency of graft polymerization, safety of operation, uniformity of graft polymerization, etc., halogenated aliphatic hydrocarbons and halogenated aromatic hydrocarbons are preferred. These organic solvents are used either singly or in combination in the form of a mixture of two or more members. The amount of the organic solvent to be used is generally from 0.1 to 20 times, preferably from 1 to 10 times, the weight of the hydrophobic radical polymerization initiator, although it is not specifically limited.

The amount of naphthalene to be used is generally from 1 to 80% by weight, preferably from 5 to 40% by weight, based on said organic solvent.

Examples of the unsaturated monomers which contain in the molecular unit thereof at least one double bond capable of radical polymerization (hereinafter referred to merely as "unsaturated monomer") and which are usable in the present invention include vinyl carboxylic acids such as acrylic acid, methacrylic acid, fumaric acid and itaconic acid and salts of said acids, vinyl sulfonic acids such as styrene sulfonic acid and vinyl sulfonic acid and salts of said acids, monovinyl carboxylic acid esters such as methyl acrylate, ethyl acrylate, ethyl itaconate, n-butyl acrylate, t-butyl methacrylate, lauryl acrylate, stearyl acrylate, cyclohexyl acrylate, hydroxyethyl acrylate, methyl methacrylate, hydroxyethyl methacrylate, glycidyl methacrylate, 2,3-dibromopropyl acrylate, methoxyethyl acrylate, ethoxyethyl methacrylate, polyethyleneglycol monoacrylate, polyethyleneglycol monomethacrylate, alkoxypolyethyleneglycol methacrylate, phenoxypolyethyleneglycol methacrylate, tetrahydrofurfuryl acrylate, phenyl acrylate, tribromophenyl acrylate and 3-hydroxy-4-benzoyl-phenyl methacrylate, vinyl phosphonic acid esters such as diethyl-vinyl phosphonate and bis(2-chloroethyl)-vinyl phosphonate, polyvinyl carboxylic acid esters of alkyleneglycols or polyhydric alcohols such as ethyleneglycol dimethacrylate, 1,4-butanediol diacrylate, neopentylglycol dimethacrylate, polyethyleneglycol diacrylate, polyethyleneglycol dimethacrylate, trimethylolpropane triacrylate and pentaerythritol tetramethacrylate, vinyl amides and derivatives thereof such as acrylamide, methacrylamide, acetone acrylamide, N-methylol acrylamide, N-methoxymethyl acrylamide, N,N-dimethyl acrylamide, N,N-diethyl methacrylamide, N,N-di(hydroxyethyl) acrylamide, adducts of acrylamide or methacrylamide and alkylene oxides, N-vinyl-2-pyrrolidone and methylene bis-acrylamide, and acrylonitrile, vinyl chloride, vinylidene chloride and styrene. These examples are purely illustrative and not in the least limitative of the unsaturated monomers usable for the present invention.

These unsaturated monomers may suitably be selected and used independently for the purpose of imparting desired properties to the graft polymer. Otherwise, they may be selected and used in combination in the form of a mixture of two or more members so as to impart varying properties either simultaneously or stepwise. When a mixture of two or more members selected from the group of hydrophilic unsaturated monomers such as unsaturated acids like acrylic acid, methacrylic acid and styrene sulfonic acid, adducts of said unsaturated acids with alkylene oxides, and unsaturated amides is used as the unsaturated monomer, the graft polymerization is obtained at a markedly higher conversion and the amount of the homopolymer to be by-produced in the reaction system is smaller than when the components of said mixture are used independently of one another. Thus, the graft polymerization occurs uniformly always with reproducibility. When methacrylic acid and acrylic acid are used in combination at a weight ratio of 80 : 20 to 20 : 80, the homopolymer to be formed on the surface of the shaped article is readily soluble with water or hot water so that the extra work of extracting said homopolymer with a solvent or hot alkaline water can be dispensed with. Besides, the graft polymerization product enjoys outstanding uniformity. Furthermore, said mixture of unsaturated monomers enjoys an advantage that it remains unfrozen in cold weather and permits the preparation of the treating liquid to be effected conveniently.

The amount of unsaturated monomer or mixture of unsaturated monomers to be used is preferably from about 0.3 to about 12% by weight, based on the weight of the aqueous emulsified dispersion.

In the present invention, an emulsifier is used to permit dispersion of said hydrophobic radical polymerization initiator, hydrophobic organic solvent, naphthalene and hydrophobic unsaturated monomer in water. Examples of the emulsifiers which are usable in this invention include anionic surface active agents, cationic surface active agents, nonionic surface active agents, nonionic-anionic surface active agents and amphoteric surface active agents which are all available on the market. Usable emulsifiers, however, are not necessarily limited to these examples. Needless to mention, it is desirable that such emulsifiers are suitably selected to meet the particular kinds of hydrophobic radical polymerization initiator, organic solvent which is liquid at normal room temperature and unsaturated monomer. Particularly in the case of graft polymerization which is effected by using, as the unsaturated monomer, a monomer possessed of an acidic group, it is preferable to use a mixture of a nonionic surface active agent and an anionic surface active agent or to use a nonionic-anionic surface active agent. If a nonionic surface active agent alone is used as the emulsifier in the graft polymerization utilizing an unsaturated monomer possessed of an acidic group, the acidic group of the homopolymer produced in the graft polymerization bath and the alkylene oxide chain contained in the nonionic surface active agent react with each other to form an insoluble complex. This insoluble complex is unevenly deposited on the surface of the graft polymer to increase the apparent efficiency of graft polymerization. As the complex is deposited, it prevents the subsequent graft polymerization from proceeding uniformly. This complex is also deposited on the wall of the polymerization bath to complicate the operation which follows the graft polymerization to a great extent.

To make the matter worse, the insoluble complex thus deposited on the graft polymerization product cannot easily be removed even by an alternate extraction using boiling water and boiling acetone. In many cases, the removal of the deposited complex necessitates neutralizing treatment with an alkali solution. Since the polymer's capability of alkali hydrolysis is enchanced to a great extent by the graft polymerization, however, there is entailed a disadvantage that in the stage of alkali neutralization the polymer is seriously degraded in strength. A consequence of this fact is that the unevenly deposited insoluble complex, if not given neutralizing treatment with an alkaline solution, brings about heavy uneven dyeing. In the method of the present invention, formation of such an insoluble complex is not observed. Thus, the graft polymerization is obtained uniformly without involving any notable formation of homopolymer and, moreover, the neutralizing treatment with an alkaline solution can be dispensed with. The graft polymerization product consequently obtained enjoys excellent mechanical properties. Also in the graft polymerization involving the use of an unsaturated monomer other than said unsaturated monomer containing the acidic group, use of such a nonionic-anionic emulsifier provides an advantage that the deposition of homopolymer does not occur heavily. The emulsifier to be used is desired to have HLB (hydrophilicity-lipophilicity balance) in the range of from 10 to 18. Although the amount of the emulsifier to be used is not specifically limited, it is desired to fall in the range of from 1 to 100%, preferably from 5 to 30%, by weight based on the total weight of the components to be dispersed, including the hydrophobic radical polymerization initiator, hydrophobic organic solvent which is liquid at normal room temperature, naphthalene and hydrophobic unsaturated monomer.

The methods which are available for the graft polymerization according to this invention will be described more specifically herein below. Examples of the methods usable for this purpose include a method whereby the shaped article of hydrophobic synthetic polymer is immersed and heated in an aqueous dispersion obtained by causing said hydrophobic radical polymerization initiator, organic solvent which is liquid at normal room temperature, naphthalene and unsaturated monomer to be dispersed with an emulsifier in water, a method whereby said aqueous dispersion is deposited on the shaped article of hydrophobic synthetic polymer by available means such as padding, spraying or spreading technique and the coated shaped article is subjected to a heating treatment, particularly to a steaming treatment, under normal pressure or an increased pressure, and a transfer method whereby said aqueous dispersion mixed in advance with a filler or a tackifier is applied to an inactive carrier and the resultant composite and the shaped article under treatment are placed one on top of the other and, in that state, heated to effect transfer-graft polymerization. Of the various available methods enumerated above, the method having the shaped article immersed and heated in the aqueous dispersion proves to be preferable from the standpoint of the efficiency of graft polymerization, reproducibility of operation, convenience of the operation subsequent to the graft polymerization, etc.

The temperature at which the graft polymerization is carried out is generally from 50° to 230° C, desirably from 70° to 130° C, in the case of the method involving the immersion and heat application. In the case of the method involving the step of impregnation with the treating liquid and the subsequent step of heat application, and in the case of the transfer method, the temperature is from 80° to 200° C. Preferable temperatures are from 95° to 130° C in the method of immersion and heat application, and from 95° to 200° C in the case of the method involving impregnation with the treating liquid and subsequent application of heat, and in the case of the transfer method, although it is variable with the particular method of graft polymerization, the composition of the graft polymerization product, the kind of the polymerization initiator, etc. It goes without saying that when the heating is performed at an elevated temperature, the radical polymerization initiator to be used is desired to be of a type having a low decomposition velocity.

The conversion of the graft polymerization is generally desired to be not more than 40% by weight in order to obtain desired modification without impairing the mechanical properties of the hydrophobic synthetic polymer, although it is variable with the particular object to which the graft polymerization is directed. Most objects are attained generally at a conversion in the range of from 0.1 to 30%, preferably from 1 to 20%, by weight.

According to the method of the present invention, the desired graft polymerization can be obtained in one stage on the shaped article of hydrophobic synthetic polymer uniformly at a high efficiency without impairing the mechanical properties and whiteness of the polymer used as the starting material. Also from the economical point of view, the method of the present invention is unusually advantageous in that it imparts various properties such as hydrophilicity, water-absorbing property, dirtproofing property, infusibility, antistatic property, dyeability with ionic dyestuffs and reactivity, depending on the particular kinds of unsaturated monomers being used, and also mends faults of hydrophobic synthetic polymers. Commercialization of the method of this invention, therefore, is highly advantageous. The polymer which has been obtained by the method of this invention, as occasion demands, may be subjected to a varying treatment for modification by making use of a reactive group of the side chain present in the graft molecule chain such as, for example, —COOH group, —OH group, $—NH_2$ group or $—NHCH_2OH$ group. Such a treatment can improve the properties obtained by the graft polymerization or can impart other properties which are not obtained by the graft polymerization alone. For example, in the case of a graft polymer which is obtained by graft polymerizing a graft monomer possessed of an acidic group onto a thermally fusible hydrophobic synthetic polymer, an aftertreatment such as with a polyvalent metal salt, a polyepoxy compound or methylol compound can induce a cross-linking bond and consequently impart infusibility and heat-proofness. Or an aftertreatment with a cationic antistatic agent can enhance the antistatic property or an aftertreatment with a fungicidal metal salt can impart antibiotic property.

The present invention will be described with reference to preferred embodiments herein below. Where parts are mentioned, they are parts by weight, and where percents are mentioned, they are percents be weight.

EXAMPLE 1

An aqueous emulsified dispersion cconsisting of 1 part benzoyl peroxide, 8 parts of a monochlorobenzene solution containing 5% of a varying additive indicated in Table 1, 1 part of a nonionic surface active agent "Neugen ET-160 ®" (the proprietary name for polyoxyethylene alkyl ether, HLB=16, made by Dai-ichi Kogyo Seiyaku Co., Ltd.), 1 part of an anionic surface active agent "Neogen T ®" (the proprietary name for alkylaryl sulfonate, HLB=11 - 12, made by Dai-ichi Kogyl Seiyaku Co., Ltd.) and 1,000 parts of water was prepared.

In a treating liquid obtained by adding 2 parts of a mixed monomer consisting of equal parts of methacrylic acid and acrylic acid to 98 parts of said aqueous emulsified dispersion, 2 parts of a knit fabric of textured yarn of polyethylene terephthalate (75 d/24 f) was immersed and subjected to graft polymerization at 100° C for 60 minutes under reflux. Then, extraction with boiling water was carried out for five hours to produce a graft polymer. The results were as shown in Table 1.

Table 1

| Additive | Ratio of grafting (%) |
|---|---|
| None | 14.58 |
| Naphthalene | 28.24 |
| α-Methylnaphthalene | 12.74 |
| β-Naphthol | 7.85 |
| Diphenyl | 8.17 |
| o-phenylphenol | 8.54 |
| Phenyl benzoate | 12.18 |

*Ratio of grafting (%) =

$$\frac{\left(\begin{array}{l}\text{Absolute dry weight}\\ \text{after graft polymerization}\\ \text{and extraction}\end{array}\right) - \left(\begin{array}{l}\text{Absolute dry weight}\\ \text{before graft}\\ \text{polymerization}\end{array}\right)}{\left(\begin{array}{l}\text{Absolute dry weight before}\\ \text{graft polymerization}\end{array}\right)} \times 100$$

It is clear from Table 1 that the ratio of grafting is increased vastly by the method of this invention which uses naphthalene. Additives other than naphthalene have been found to give lower ratios of grafting. Use of α-methyl naphthalene has been observed to entail a disadvantage of discoloring the graft polymerization product in yellow tint.

EXAMPLE 2

An aqueous emulsified dispersion consisting of 1 part of benzoyl peroxide, 8 parts of a mixed solution consisting of equal parts of o- dichlorobenzene and trichlorobenzene containing a prescribed concentration of naphthalene, 1 part of Neugen ET-160 ®, 1 part of Neogen T ® and 1,000 parts of water was prepared. A treating liquid was obtained by adding to 98 parts of this aqueous emulsified dispersion 2 parts of a mixed monomer consisting of equal parts of methacrylic acid and acrylic acid. In the treating liquid, 2 parts of a knit fabric of textured yarn of polyethylene terephthalate was immersed and subjected to graft polymerization at 100° C for 60 minutes under reflux. Then, extraction with boiling water was carried out for 5 hours to produce a graft polymer. The results were as shown in Table 2.

Table 2

| Concentration of naphthalene in mixed solution of o-dichlorobenzene and trichlorobenzene | Ratio of grafting (%) |
|---|---|
| 0 (%) | 13.50 |
| 5 | 26.20 |
| 15 | 32.60 |
| 35 | 35.50 |

It is clear from Table 2 that the ratio of grafting is increased by incorporation of naphthalene in the aqueous emulsified dispersion and that this increase in grafting ratio is proportional with the increase in the concentration of naphthalene. The graft polymers obtained from the dispersions using a mixed surface active agent were free from deposition of complex and enjoyed uniform composition.

EXAMPLE 3

An aqueous emulsified dispersion consisting of 1 part of benzoyl peroxide, 1.5 parts of naphthalene, 5 parts of monochlorobenzene, 1 part of Prisurf A-217E® (the proprietary name for polyoxyethylene alkyl phenyl ether phosphate, HLB=14.9, made by Dai-ichi Kogyo Seiyaku Co., Ltd.) and 1,000 parts of water was prepared. A treating liquid was produced by adding to 100 parts of this aqueous emulsified dispersion 1.5 parts of a mixed solution consisting of prescribed parts of acrylic acid and methacrylic acid. In the treating liquid, 3 parts of a knit fabric of polyethylene terephthalate was immersed and the container holding the liquid and the fabric was sealed under a nitrogen atomsphere. Thereafter, the contents were subjected to graft polymerization at 100° C for 60 minutes while under shaking and agitation. The resultant graft polymer was immersed into water at room temperature over night. Then, extraction of homopolymer with boiling ethyl alcohol was carried out for five hours to produce a graft polymer. The results were as shown in Table 3.

Table 3

| Mixing ratio of acrylic acid and methacrylic acid by weight | Ratio of grafting (%) |
|---|---|
| 10/0 | 4.0 |
| 9/1 | 4.2 |
| 8/2 | 5.8 |
| 7/3 | 10.9 |
| 6/4 | 14.1 |
| 5/5 | 15.8 |
| 4/6 | 16.0 |
| 3/7 | 15.5 |
| 2/8 | 13.2 |
| 1/9 | 10.1 |
| 0/10 | 8.5 |

It is seen from Table 3 that notably high ratios of grafting are obtained where the mixing ratio of acrylic acid and methacrylic acid falls in the range of from 7:3 to 1:9 particularly from 7 : 3 to 2 : 8.

EXAMPLE 4

The same knit fabric as used in Example 3 was subjected to graft polymerization by faithfully following the procedure of Example 3, except that the unsaturated monomer used in Example 3 was substituted by 1.8 parts of a mixture consisting of methoxy polyethyleneglycol (molecular weight of 400) methacrylate and a mixture of equal parts of acrylic acid and methacrylic acid at a prescribed ratio. Subsequently, extraction with boiling water was carried out for three hours to produce a graft polymer. The results were as shown in Table 4.

Table 4

| Mixing ratio of methoxy polyethyleneglycol methacrylate and a mixture of equal parts of acrylic acid and methacrylic acid | Ratio of grafting (%) |
|---|---|
| 10/0 | 15.2 |
| 8/2 | 24.0 |
| 6/4 | 33.7 |
| 4/6 | 37.3 |
| 2/8 | 32.0 |
| 0/10 | 21.0 |

Use of a mixed monomer has been shown to give a very high ratio of grafting. The graft polymers obtained from the dispersions using a mixed monomer have been observed to excel in wicking property, hygroscopicity, antistatic property and freedom from becoming oily.

EXAMPLE 5

An aqueous emulsified dispersion consisting of 1 part of benzoyl peroxide, 8 parts of a monochlorobenzene solution containing a varying prescribed concentration of naphthalene, 1 part of a nonionic-anionic surface active agent "Prisurf A-217E®" (the proprietary name for polyoxyethylene alkyl phenyl ether phosphate made by Dai-ichi Kogyo Seiyaku Co., Ltd.) and 1,000 parts of water was prepared. A treating liquid was produced by adding to 98 parts of this aqueous emulsified dispersion 2 parts of a mixed monomer consisting of equal parts of methacrylic acid and acrylic acid. In this treating liquid, 2 parts of a knit fabric of textured yarn of polyethylene terephthalate was immersed and subjected to graft polymerization at 100° C for 60 minutes under reflux. Then, extraction with boiling water was carried out for five hours to produce a graft polymer. The results were as shown in Table 5.

Table 5

| Concentration of naphthalene in monochlorobenzene | Ratio of grafting (%) |
|---|---|
| 0 (%) | 14.00 |
| 5 | 23.10 |
| 15 | 27.80 |
| 35 | 31.10 |

It is clear from Table 5 that the ratio of grafting is vastly increased by incorporation of naphthalene in the aqueous emulsified dispersion and that the increase of grafting ratio is proportional with the increase in the concentration of naphthalene. The grapt polymers obtained from the dispersions using a nonionic-anionic surface active agent were free from deposition of a complex and enjoyed uniform composition.

EXAMPLE 6

The grapt polymer obtained in Example 2 by use of the mixed solution containing 5% of naphthalene was extracted with boiling water for five hours, then subjected to a neutralizing treatment in an aqueous 0.5% sodium carbonate solution at 50° C for 60 minutes and thereafter washed with water and dried.

By way of comparison, an aqueous emulsified dispersion consisting of 1 part of benzoyl peroxide, 8 parts of a mixture of equal parts of o-dichlorobenzene and trichlorobenzene, 2 parts of Neugen ET-160® and 1,000 parts of water was prepared. A treating liquid was produced by adding to 98 parts of this aqueous emulsified dispersion 2 parts of a mixed monomer of equal parts of methacrylic acid and acrylic acid. Graft polymerization was similarly carried out in this treating liquid. The resultant graft polymer was extracted with boiling water and subjected to the neutralizing treatment.

The graft polymers were tested for grafting ratio before and after said neutralizing treatment, for uniformity of graft polymerization as determined in terms of dyeability with a basic dyestuff, and for breaking strength. The results were as shown in Table 6.

Table 6

| | | After extraction with boiling water | After neutralizing treatment |
|---|---|---|---|
| This invention | Ratio of grafting (%) | 26.20 | 26.0 |
| | uniformity* | o | o |
| | Strength (g/d) | 4.8 – 5.2 | — |
| Comparative test | Ratio of grafting (%) | 16.35 | 12.3 |
| | Uniformity* | × | Δ |
| | Strength (g/d) | 4.8 – 5.2 | 3.0 – 3.2 |

*o : Uniform
Δ : Rather non-uniform
× : Non-uniform

It is evident from Table 6 that the graft polymerization carried out by the method of the present invention using naphthalene showed a higher ratio of grafting and excellent uniformity. When a nonionic and anionic emulsifiers were used in combination, the by-produced homopolymer was readily extracted, and removed by only extraction with water and the produced graft polymer showed an ability to provide even dyeing and exhibited outstanding mechanical properties. In the comparative test which used no naphthalene, the ratio of grafting was low. When a nonionic emulsifier alone was used, the insoluble complex deposited on the surface of graft polymer could not be removed even by extraction with water and the graft polymer provided highly uneven dyeing. The insoluble complex could not be removed unless by the neutralizing treatment. After removal of said complex, the graft polymer was improved in its uniform dyeability to a considerable extent, though not to a satisfactory extent. The treatment for neutralization, however, brought about a heavy decline in strength.

EXAMPLE 7

An aqueous emulsified dispersion consisting of 2 parts of azo-bis-isobutyronitrile, 8 parts of a monochlorobenzene solution containing 5% of naphthalene, 2 parts of Neugen ET-100® (the proprietary mean for polyoxyethylene alkyl ether, HLB 10.0, made by Dai-ichi Kogyo Seiyaku Co., Ltd.) and 1,000 parts of water was prepared. A treating liquid was produced by adding to 98 parts of this aqueous emulsified dispersion 2 parts of acrylamide. In this treating liquid, 2 parts of polyethylene terephthalate was immersed and subjected to graft polymerization at 100° C for 60 minutes under reflux. Then, extraction with boiling water was carried out for 60 minutes to produce a graft polymer. Consequently, the ratio of grafting was found to be 7.1%. In a comparative test which was performed in an aqueous dispersion containing no naphthalene, the ratio of grafting was only 2.2%.

EXAMPLE 8

An aqueous emulsified dispersion consisting of 1 part of benzoyl peroxide, 10 parts of a monochlorobenzene solution containing 20% naphthalene, 8 parts of a varying unsaturated monomer shown in Table 7, 2 parts of Prisurf A-217E® and 1,000 parts of water was prepared. In 100 parts of the aqueous emulsified dispersion, 3 parts of the same knit fabric of polyethylene terephthalate as used in Example 1 was immersed. The container holding the liquid and the fabric was sealed under a nitrogen atmosphere. Thereafter, the contents were subjected to graft polymerization at 100° C for 60 minutes under shaking and agitation. Subsequently, extraction by boiling in a varying solvent shown in Table 7 was carried out for five hours under reflux to produce a graft polymer. The results were as shown in Table 7.

Table 7

| Unsaturated monomer | Solvent for extraction | Ratio of grafting (%) |
|---|---|---|
| Methacrylic acid | 0.02 mole solution of hydrochloric acid | 7.0 |
| Methyl methacrylate | Acetone | 28.3 |
| Ethyl acrylate | Acetone | 26.5 |
| Acrylamide | Water | 6.1 |
| 2,4,6-Tribromophenyl acrylate | Benzene | 19.7 |

The methacrylic acid-grafted product acquired hydrophilicity and infusibility. After a neutralizing treatment which was performed with sodium carbonate as indicated in Example 6, the product showed a water drop absorption velocity of less than 1 second and a hygroscopicity of 3.0% at 20° C and 65% RH as measured by Testing Method 39 of AATCC. Compared with the unmodified product which showed a water drop absorption velocity of more than 600 seconds and a hygroscopicity of 0.4%, the modified product is found to have acquired a highly improved hydrophilicity. When the methacrylic acid-grafted product which had undergone said neutralizing treatment was held horizontally and a hollow glass sphere measuring 1.5 cm in diameter and weighing 1.5 g which had been heated to 450° C was placed on the product, the hot sphere hardly sank under the surface of the product. In the case of the product which had not be modified, the hollow glass sphere heated to 300° C melted its way through the product. Grafting of methyl methacrylate or ethyl acrylate improved the knit fabric in compactness of mesh to a notable extent. The 2,4,6-tribromophenyl acrylate-grafted product exhibited an outstanding flame-retarding property and was found to have a carbonization length of 4.6 cm as measured by the DOCFF-3-71 Method. The various properties acquired by these graft polymers showed very little change after household laundering or dry cleaning.

EXAMPLE 9

An aqueous emulsified dispersion consisting of 1 part of benzoyl peroxide, 1.5 parts of naphthalene, 5 parts of monochlorobenzene, 1 part of Prisurf A-217E® and 1,000 parts of water was prepared. A treating liquid was produced by adding to 100 parts of this aqueous dispersion a prescribed amount of a mixture of equal parts of acrylic acid and methacrylic acid. In the treating liquid, 3 parts of skeins of textured nylon 6 yarn (70 d/24 f, two-fold) were immersed and subjected to graft polymerization by following the procedure of Example 3. Then, extraction with boiling water was carried out for three hours to produce a graft polymer. The results were as shown in Table 8.

Table 8

| Amount (parts) of mixed solution of equal parts of acrylic acid and methacrylic acid | Rate of grafting (%) |
|---|---|
| 0.3 | 5.5 |
| 0.5 | 8.7 |
| 0.8 | 15.2 |
| 1.0 | 19.1 |

The graft polymers thus obtained have been demonstrated to excel in uniformity of grafting as a result of a dyeing test using a basic dyestuff.

EXAMPLE 10

The same knit fabric of polyethylene terephthalate as used in Example 3 was treated by following the procedure of Example 3, except that (1) 1.5 parts of a mixture consisting of equal parts of acrylic acid and methacrylic acid or (2) 1.5 parts of a mixture consisting of equal parts of acrylic acid and methacrylic acid and 0.2 part of 3-hydroxy-4-benzoyl phenyl methacrylate were used as the unsaturated monomer in the treating liquid for graft polymerization. The resultant graft polymer was left to stand under acetone overnight. Then extraction with boiling water was carried out for three hours. Consequently, there were obtained graft polymers showing 15.6% and 17.1% grafting ratio.

The graft polymers thus obtained were dyed at 120° C for 60 minutes in the bath (volume of liquor 1 : 100) of an aqueous solution containing 1% owf of Resoline Blue-FBL ® (the proprietary name for a dyestuff C.I. disperse blue 56, made by Bayer AG) and 0.1% of Disper TL ® (the proprietary name for a dispersant made by Meisei Chemical) and then subjected to soaping at 80° C for 30 minutes in the bath (volume of liquor 1 : 50) of an aqueous solution containing 0.2% of Neugen HC (the proprietary name for polyoxyethylene alkyl phenyl ether made by Dai-ichi Kogyo Yakuhin Co., Ltd.) and 0.2% of sodium carbonate and thereafter washed with water and dried. The dyed articles were subjected to an exposure test with a Fade-O-meter by following the method of JIS L-0842-1971, with necessary modifications, by way of testing for color fastness. The test piece having co-grafted thereto 3-hydroxy-4-benzoyl phenyl methacrylate showed a color fastness of higher than Grade 5, whereas the test piece which did not use 3-hydroxy-4-benzoyl phenyl methacrylate showed a color fastness of Grade 2.

EXAMPLE 11

An aqueous emulsified dispersion consisting of 1 part of dicumyl peroxide, 1.5 parts of naphthalene, 5 parts of monochlorobenzene, 1 part of Prisurf A-217E ® and 1,000 parts of water was prepared. A treating liquid was produced by adding to 100 parts of this aqueous dispersion 1.5 parts of a mixture of equal parts of acrylic acid and methacrylic acid. In this treating liquid, 3 parts of a needle-punched nonwoven fabric of polyethylene terephthalate filaments (monofilament denier number 4, weight 80 g/m$^2$ and density 0.40 g/cm$^3$) was immersed and subjected to graft polymerization by following the procedure of Example 3. Then extraction with boiling water was carried out for three hours to produce a graft polymer of a grafting ratio of 18.4%.

EXAMPLE 12

The same knit fabric of polyethylene terephthalate as described in Example 1 was immersed in an aqueous emulsified dispersion consisting of 15 parts of neopentylglycol dimethacrylate, 0.5 part of dicumyl peroxide, 2 parts of naphthalene, 6 parts of monochlorobenzene, 1 part of Prisurf A-217E ® and 100 parts of water. Then the fabric was squeezed to a pickup ratio of 100% and treated in a high-pressure steam at 130° C for 30 minutes. Then, the fabric was washed in the bath (volume of liquor 1 : 50) of an aqueous solution containing 0.2% of Neugen HC ® and 0.2% of sodium carbonate at 80° C for 30 minutes and thereafter dried. The increase of weight was found to be 10.7%.

The grafted product was tested for fusibility by using a heated hollow glass sphere in the same way as in Example 8. Even when the glass sphere was at 450° C, it sank very little under the surface of the product, indicating that the product had excellent infusibility.

What is claimed is:

1. A method for the graft polymerization of a shaped article of hydrophobic synthetic polymer, which comprises treating the shaped article with an aqueous emulsified dispersion containing water, an emulsifier, a hydrophobic radical polymerization initiator, an organic solvent which is liquid at normal room temperature, naphthalene and at least one unsaturated monomer containing in the molecular unit thereof at least one double bond capable of radical polymerization, the amount of naphthalene in the dispersion being from 1 to 80% by weight, based on the weight of the organic solvent, with the proviso that when the unsaturated monomer contains an acidic group, the emulsifier is (1) a mixture of a nonionic surface active agent and an anionic surface active agent or (2) a nonionic-anionic surface active agent.

2. The method set forth in claim 1, wherein the hydrophobic radical polymerization initiator is one member selected from the group consisting of diacyl peroxides, peroxy esters, ketone peroxides, dialkyl peroxides, hydroperoxides, perbenzoic acid and azo-bis-isobutyronitrile.

3. The method set forth in claim 1, wherein the unsaturated monomer is a mixture consisting of acrylic acid and methacrylic acid in a weight ratio of from 20 : 80 to 80 : 20.

4. The method set forth in claim 1, wherein the organic solvent is one member selected from the group consisting of alcohols, phenols, ketones, ethers and hydrocarbons.

5. The method set forth in claim 1, wherein the organic solvent is one member selected from the group consisting of halogenated aliphatic hydrocarbons and halogenated aromatic hydrocarbons.

6. The method set forth in claim 1, wherein the emulsifier is one member selected from the group consisting of (1) a mixture of a nonionic surface active agent with an anionic surface active agent and (2) a nonionic-anionic surface active agent.

7. The method set forth in claim 1, wherein the emulsifier has an HLB value in the range of from 10 to 18.

8. The method set forth in claim 1, wherein the amount of naphthalene in the dispersion is from 5 to 40% by weight, based on the weight of the organic solvent.

9. The method set forth in claim 1, wherein the amount of the hydrophobic radical polymerization initiator is from 0.005 to 5% by weight, based on the weight of the dispersion, the amount of the unsaturated monomer component is from about 0.3 to about 12% by weight, based on the weight of the dispersion, the amount of the organic solvent is from 0.1 to 20 times the weight of the hydrophobic radical polymerization initiator, and the amount of the emulsifier is from 1 to 100% by weight, based on the total weight of the hydrophobic radical polymerization initiator, hydrophobic organic solvent, the naphthalene and hydrophobic unsaturated monomer component.

10. The method set forth in claim 1, wherein the amount of the hydrophobic radical polymerization initiator is from 0.05 to 0.5% by weight, based on the weight of the dispersion, the amount of the unsaturated monomer component is from about 0.3 to about 12% by weight, based on the weight of the dispersion, the amount of the organic solvent is from 1 to 10 times the weight of the hydrophobic radical polymerization initiator, and the amount of the emulsifier is from 5 to 30% by weight, based on the total weight of the hydrophobic radical polymerization initiator, hyrophobic organic solvent, the naphthalene and hydrophobic unsaturated monomer component.

11. The method set forth in claim 1, wherein treatment of the shaped article is carried out by immersing the shaped article in the dispersion and heating the immersed shaped article at 70° to 130° C.

12. The method set forth in claim 11, wherein the hydrophobic radical polymerization initiator is benzoyl peroxide or dicumyl peroxide.

13. The method set forth in claim 11, wherein the immersed shaped article is heated at 95° to 130° C.

14. The method set forth in claim 1, wherein treatment of the shaped article is carried out by impregnating the shaped article with the dispersion and heating the impregnated article at 80° to 200° C.

15. The method set forth in claim 14, wherein the impregnated shaped article is heated at 95° to 200° C.

16. The method set forth in claim 1, wherein treatment of the shaped article is carried out by mixing the dispersion with a filler or a tackifier, applying the resultant mixture to an inactive carrier to form a composite, placing the composite and the shaped article on top of one another, and heating the resultant combination at 80° to 200° C.

17. The method set forth in claim 16, wherein the resultant combination is heated at 95° to 200° C.

18. The method set forth in claim 1, wherein the unsaturated monomer is at least one member selected from the group consisting of vinyl carboxylic acids, salts of vinyl carboxylic acids, vinyl sulfonic acids, salts of vinyl sulfonic acids, monovinyl carboxylic acid esters, vinyl phosphonic acid esters, polyvinyl carboxylic acid esters of alkyleneglycols or polyhydric alcohols, vinyl amides, derivatives of vinyl amides, acrylonitrile, vinyl chloride, vinylidene chloride and styrene.

19. The method set forth in claim 1, wherein the unsaturated monomer is a mixture of at least two unsaturated monomers selected from the group consisting of unsaturated acids, adducts of said unsaturated acids with alkylene oxides, and amides of said unsaturated acids.

20. The method set forth in claim 19, wherein the unsaturated acids are acrylic acid, methacrylic acid and styrene sulfonic acids.

21. The method set forth in claim 1, wherein the unsaturated monomer is a polyvinyl carboxylic acid ester of an alkyleneglycol or a polyhydric alcohol.

22. The method set forth in claim 1, wherein the shaped article is an aromatic polyester in the form of one member selected from the group consisting of a tow, a downy mass, a thread, a knit fabric, a woven fabric, a nonwoven fabric, a flooring, a synthetic paper and a film.

23. The method set forth in claim 1, wherein the shaped article is a polyamide in the form of one member selected from the group consisting of a tow, a downy mass, a thread, a knit fabric, a woven fabric, a nonwoven fabric, a flooring, a synthetic paper and a film.

* * * * *